US009410089B2

(12) United States Patent
Schlosberg et al.

(10) Patent No.: US 9,410,089 B2
(45) Date of Patent: Aug. 9, 2016

(54) PROPANE PROCESS FOR PRODUCING CRUDE OIL AND BITUMEN PRODUCTS

(71) Applicant: EPIC OIL EXTRACTORS, LLC, Ponchatoula, LA (US)

(72) Inventors: Richard H. Schlosberg, Highland Park, IL (US); Richard D. Jordan, Vienna, VA (US); Edward L. Diefenthal, Metairie, LA (US)

(73) Assignee: Epic Oil Extractors, LLC, Ponchatoula, LA (US)

( * ) Notice: Subject to any disclaimer, the term of this patent is extended or adjusted under 35 U.S.C. 154(b) by 128 days.

(21) Appl. No.: 14/135,435

(22) Filed: Dec. 19, 2013

(65) Prior Publication Data

US 2015/0175894 A1 Jun. 25, 2015

(51) Int. Cl.
*C10G 1/04* (2006.01)

(52) U.S. Cl.
CPC ..... *C10G 1/045* (2013.01); *C10G 1/042* (2013.01)

(58) Field of Classification Search
CPC ..... C10G 1/04; C10G 1/045
See application file for complete search history.

(56) References Cited

U.S. PATENT DOCUMENTS

| | | | | |
|---|---|---|---|---|
| 7,985,333 | B2 * | 7/2011 | Duyvesteyn | C10G 1/04 208/390 |
| 2011/0174691 | A1 * | 7/2011 | Reynolds | B01J 27/049 208/123 |

* cited by examiner

*Primary Examiner* — Brian McCaig
(74) *Attorney, Agent, or Firm* — Dickinson Wright PLLC

(57) ABSTRACT

Disclosed are processes for producing bitumen-derived crude oil and heavy bitumen compositions from oil sand. The processes involve treating oil sand feedstock with a first hydrocarbon solvent comprised of propane to produce the bitumen-derived crude oil composition having an asphaltene content of not greater than 5 wt % pentane insoluble, and an oil-depleted oil sand. The oil-depleted oil sand is treated with a second hydrocarbon solvent comprised of propane and a fraction of the bitumen-derived crude oil composition to produce the heavy bitumen composition and oil sand tailings. The oil sand tailings are dried by contacting the tailings with a drying composition comprised of a majority of propane.

11 Claims, No Drawings

PROPANE PROCESS FOR PRODUCING CRUDE OIL AND BITUMEN PRODUCTS

This invention relates to a method for producing crude oil and bitumen products. In particular, this invention relates to producing crude oil and bitumen products from oil sand using hydrocarbon solvents.

BACKGROUND OF THE INVENTION

Oil sands (also called tar sands) are mixtures of organic matter, quartz sand, bitumen, and water that can either be mined or extracted in-situ using thermal recovery techniques. Typically, oil sands contain about 75% inorganic matter, 10% bitumen, 10% silt and clay, and 5% water. Bitumen is a heavy crude that does not flow naturally because of its low API (less than 10 degrees) and high sulfur content. The bitumen has high density, high viscosity, and high metal concentration. There is also a high carbon-to-hydrogen molecule count (i.e., oil sands are low in hydrogen). This thick, black, tar-like substance must be upgraded with an injection of hydrogen or by the removal of some of the carbon before it can be processed.

Oil sand products are sold in two forms: (1) as a raw bitumen that must be blended with a diluent (becoming a bit-blend) for transport and (2) as a synthetic crude oil (SCO) after being upgraded to constitute a light crude. The diluent used for blending is less viscous and often a by-product of natural gas, e.g., a natural gas condensate. The specifications for the bit blend (heavy oil) are 21.5 API and a 3.3% sulfur content and for the SCO (light oil) are 36 API and a 0.015% sulfur content. See *Canada's Oil Sands*, May 2004, p. 10.

Oil sands production measured only 1.3% of total world crude oil production in 2005. By 2025 it may reach 4.1% of total world production according to http://www.fas.org/sgp/crs/misc/RL34258.pdf.

Oil sands are either surface-mined or produced in-situ. Mining works best for deposits with overburden less than 75 meters thick. Mining requires a hydraulic or electric shovel that loads the sand into 400-ton trucks, which carry the material to a crusher to be mixed into a slurry. Using pumps and pipelines, the slurry is "hydro transported" to an extraction facility to extract bitumen. This process recovers about 90% of the bitumen.

The bitumen extraction process for mined oil sands in commercial use today separates the bitumen from the oil sands using warm water (75 degrees Fahrenheit) and chemicals. Extracting the oil from the sand after it is slurried consists of two main steps. First is the separation of bitumen in a primary separation vessel. Second, the bitumen material is sent to the froth tank for diluted froth treatment to recover the bitumen and reject the residual water and solids. The bitumen is treated either with a naphtha solvent or a paraffinic solvent to cause the solids to easily settle. The paraffinic treatment results in a product that can be shipped via pipeline and that is more easily blended with refinery feedstock. After processing, the bitumen oil is sold as raw bitumen or upgraded and sold as SCO.

Upgrading the bitumen uses the process of coking for carbon removal or hydrocracking for hydrogen addition. Coking is a common carbon removal technique that "cracks" the bitumen using heat and catalysts, producing light oils, natural gas, and coke (a solid carbon byproduct). The coking process is highly aromatic and produces a low quality product. The product must be converted in a refinery to a lighter gas and distillate. Hydrocracking also cracks the oil into light oils but produces substantially no coke byproduct. Hydrocracking requires natural gas for conversion to hydrogen. Hydrocracking, used often in Canada, better handles the aromatics. The resulting SCO has little residue, which help keep its market value high, equivalent to light crude.

Partial upgrading raises the API of the bitumen to 20-25 degrees for pipeline quality crude. A full upgrade would raise the API to between 30-43 degrees—closer to higher grade conventional crude. An integrated mining operation includes mining and upgrading. Many of the mining operations have an on-site upgrading facility, including those of Suncor and Syncrude. Suncor uses the coking process for upgrading, while Syncrude uses both coking and hydrocracking and Shell uses hydrocracking.

Water supply and waste water disposal are among the most serious concerns because of heavy use of water to extract bitumen from the sands. For an oil sands mining operation, about 2-3 barrels of water are used from the Athabasca River for each barrel of bitumen produced; but when recycled produced water is included, 0.5 barrels of "make-up" water is required, according to the Alberta Department of Energy. Oil sands projects currently divert 150 million cubic meters of water annually from the Athabasca River but are approved to use up to 350 million cubic meters. Concerns, however, arise over the inadequate flow of the river to maintain a healthy ecosystem and meet future needs of the oil sands industry. Additionally, mining operations impact freshwater aquifers by drawing down water to prevent pit flooding.

Wastewater tailings (a bitumen, sand, silt, and fine clay particles slurry) also known as "fluid fine tailings" are disposed in large ponds until the residue is used to fill mined-out pits. Seepage from the disposal ponds can result from erosion, breaching, and foundation creep. The principal environmental threat is the migration of tails to a groundwater system and leaks that might contaminate the soil and surface water. The tailings are expected to reach 1 billion cubic meters by 2020. Impounding the tailings will continue to be an issue even after efforts are made to use alternative extraction technology that minimizes the amount of tails. Tailings management criteria were established by the Alberta Energy and Utilities Board/Canadian Environmental Assessment Agency in June 2005. Ongoing extensive research by the Canadian Oil Sands Network for Research and Development (CONRAD) is focused on the consolidation of wastewater tailings, detoxifying tailings water ponds, and reprocessing tailings.

Waterless approaches using hydrocarbon solvent extraction technology have been examined. These approaches offer a pathway to obtaining oil from oil sands that could be potentially low energy, water free, and environmentally superior to the current water-based technology.

U.S. Pat. No. 3,475,318 to Gable et al. is directed to a method of selectively removing oil from oil sands by solvent extraction with subsequent solvent recovery. The extraction solvent consists of a saturated hydrocarbon of from 5 to 9 carbon atoms per molecule. Volatile saturated solvents such as heptane, hexane and non-aromatic gasoline are used to selectively remove saturated and aromatic components of the bitumen from the oil sand, while leaving the corresponding asphaltenes on the sand. In order to remove the asphaltenes for potential use as process fuel, an aromatic such as benzene or toluene is added to the solvent at a concentration of from 2 to 20 weight percent.

U.S. Pat. No. 4,347,118 to Funk et al. is directed to a solvent extraction process for tar sands, which uses a low boiling solvent having a normal boiling point of from 20° C. to 70° C. to extract the bitumen from the tar sands. The solvent is mixed with tar sands in a dissolution zone at a solvent: bitumen weight ratio of from about 0.5:1 to 2:1. This mixture is passed to a separation zone containing a classifier and countercurrent extraction column, which are used to separate bitumen and inorganic fines from extracted sand. The extracted sand is introduced into a first fluid-bed drying zone fluidized by heated solvent vapors, to remove unbound solvent from extracted sand and lower the water content of the sand to less than about 2 wt. %. The treated sand is then passed into a second fluid-bed drying zone fluidized by a heated inert gas to remove bound solvent. Recovered solvent is recycled to the dissolution zone.

U.S. Pat. No. 7,985,333 to Duyvesteyn is directed to a method for obtaining bitumen from tar sands. The method includes using multiple solvent extraction or leaching steps to separate the bitumen from the tar sands. A light aromatic solvent such as toluene, xylene, kerosene, diesel (including biodiesel), gas oil, light distillate, commercially available aromatic solvents such as Solvesso 100, 150, and 200, naphtha, benzene and aromatic alcohols can be used as a first solvent. A second hydrocarbon solvent, which includes aliphatic compounds having 3 to 9 carbon atoms and liquefied petroleum gas, can also be used in the extraction process.

U.S. Patent Pub. No. 2009/0294332 to Ryu discloses an oil extraction process that uses an extraction chamber and a hydrocarbon solvent rather than water to extract the oil from oil sand. The solvent is sprayed or otherwise injected onto the oil-bearing product, to leach oil out of the solid product resulting in a composition comprising a mixture of oil and solvent, which is conveyed to an oil-solvent separation chamber.

U.S. Patent Pub. No. 2010/0130386 to Chakrabarty discloses the use of a solvent for bitumen extraction. The solvent includes (a) a polar component, the polar component being a compound comprising a non-terminal carbonyl group; and (b) a non-polar component, the non-polar component being a substantially aliphatic substantially non-halogenated alkane. The solvent has a Hansen hydrogen bonding parameter of 0.3 to 1.7 and/or a volume ratio of (a):(b) in the range of 10:90 to 50:50.

U.S. Patent Pub. No. 2011/0094961 to Phillips discloses a process for separating a solute from a solute-bearing material. The solute can be bitumen and the solute-bearing material can be oil sand. A substantial amount of the bitumen can be extracted from the oil sand by contacting particles of the oil sand with globules of a hydrocarbon extraction solvent. The hydrocarbon extraction solvent is a $C_1$-$C_5$ hydrocarbon. The particle size of the oil sand and the globule size of the extraction solvent are balanced such that little if any bitumen or extraction solvent remains in the oil sand.

U.S. Patent Pub. No. 2012/0261313 to Diefenthal et al. is directed to a process for producing a crude oil composition from oil sand that uses a solvent comprised of a hydrocarbon mixture. The solvent is injected into a vessel and the oil sand is supplied to the vessel such that the solvent and oil sand contact one another in the vessel, i.e., contact zone of the vessel. The process is carried out such that not greater than 80 wt % of the bitumen is removed from the supplied oil sand, with the removal being controlled by the Hansen solubility blend parameters of the solvent and the vapor condition of the solvent in the contact zone. The extracted oil and at least a portion of the solvent are removed from the vessel for further processing as may be desired.

U.S. Patent Pub. No. 2013/0220890 to Ploemen et al. is directed to a method for extracting bitumen from an oil sand stream. The oil sand stream is contacted with a liquid comprising a solvent to obtain a solvent-diluted oil sand slurry. The solvent-diluted oil sand slurry is separated to obtain a solids-depleted stream and a solids-enriched stream. The solvent-to-bitumen weight ratio (S/B) of the solids-enriched stream is increased to produce a solids-enriched stream having an increased S/B weight ratio and a liquid stream. The solids-enriched stream having an increased S/B weight ratio is filtered to obtain the bitumen-depleted sand. The solvent can include aromatic hydrocarbon solvents and saturated or unsaturated aliphatic hydrocarbon solvents.

There is a continuing need for waterless approaches using hydrocarbon solvent extraction technology to extract crude oil and bitumen products from oil sand. There is a particular need for obtaining high quality crude oil and obtaining relatively dry tailings from the hydrocarbon extraction processes.

SUMMARY OF THE INVENTION

This invention provides a waterless approach using hydrocarbon solvent extraction technology to extract crude oil and bitumen products from oil sand. The invention further provides a high quality crude product and produces relatively dry tailings from hydrocarbon extraction process.

According to one aspect of the invention, there is provided a process for producing a bitumen-derived crude oil composition and a bitumen composition from an oil sand feedstock. The process comprises a step of treating the oil sand feedstock with a first hydrocarbon solvent to produce the bitumen-derived crude oil composition and an oil-depleted oil sand. The oil sand feedstock is comprised of at least 6 wt % bitumen, based on total weight of the oil sand, and the first hydrocarbon solvent is comprised of a majority of propane.

The bitumen-derived crude oil composition is separated from the oil-depleted oil sand, with the bitumen-derived crude oil composition having an asphaltene content of not greater than 5 wt % pentane insolubles measured according to ASTM D4055-04. The oil-depleted oil sand also contains less bitumen than that on the oil sand feedstock.

The oil-depleted oil sand is treated with a second hydrocarbon solvent to produce the heavy bitumen composition and oil sand tailings. The second hydrocarbon solvent is comprised of propane and a fraction of the bitumen-derived crude oil composition. The oil sand tailings are contacted with a drying composition comprised of a majority of propane.

The first hydrocarbon solvent can be comprised of at least 80 wt % propane. Preferably, the first hydrocarbon solvent has a ketone content of less than 5 wt %. It is further preferred that the first hydrocarbon solvent have an aromatic content of less than 5 wt %.

As an example, the second hydrocarbon solvent can comprised of from 95 wt % to 5 wt % of the propane and from 5 wt % to 95 wt % of the bitumen-derived crude oil. The second hydrocarbon solvent can be comprised of from 95 wt % to 5 wt % of the propane and from 5 wt % to 95 wt % of the bitumen-derived crude oil composition. The bitumen-derived crude oil composition can have a nickel plus vanadium content of not greater than 50 wppm, based on total weight of the composition. The bitumen-derived crude oil composition can also have an asphaltene content of not greater than 3 wt % pentane insoluble, based on total weight of the composition.

The second hydrocarbon solvent can have an ASTM D7169 IBP of not greater than 100° C. For example, the second hydrocarbon solvent can have an ASTM D7169 50% distillation point within the range of from 100° C. to 450° C.

The drying composition used to dry the tailings can be substantially comprised of propane. For example, the drying composition used to dry the tailings can be comprised of at least 80 wt % propane.

DETAILED DESCRIPTION OF THE INVENTION

Processing of Oil Sand

This invention provides processes for producing bitumen-derived crude oil having a low asphaltene content and a heavy bitumen composition from mined oil sand. The crude oil and bitumen production processes are much more environmentally friendly than known processes for producing crude oil and bitumen products from oil sands.

The processes for producing the high quality crude oil and bitumen products involve using different hydrocarbon solvents. A first solvent is used to produce a bitumen-derived crude oil low in asphaltene content. A second solvent is used to produce a heavy bitumen composition. A drying composition is used to dry the oil sand tailings, and the dried oil sands tailings have little if any solvent. The tailings, therefore, can be returned to the earth without forming environmentally unacceptable tailings ponds.

Oil Sand

Crude oil and heavy bitumen (high asphaltene bitumen) products can be extracted from any oil sand according to this invention. The oil sand can also be referred to as tar sand or bitumen sand. Additionally, the oil sand can be characterized as being comprised of a porous mineral structure, which contains an oil component. The entire oil content of the oil sand can be referred to as bitumen.

One example of an oil sand from which a crude oil product, as well as a bitumen product relatively high in asphaltenes content, can be produced according to this invention can be referred to as water wet oil sand, such as that generally found in the Athabasca deposit of Canada. Such oil sand can be comprised of mineral particles surrounded by an envelope of water, which may be referred to as connate water. The raw bitumen material of such water wet oil sand may not be in direct physical contact with the mineral particles, but rather formed as a relatively thin film that surrounds a water envelope around the mineral particles.

Another example of oil sand from which a crude oil composition, as well as a bitumen product relatively high in asphaltenes content, can be produced according to this invention can be referred to as oil wet oil sand, such as that generally found in Utah. Such oil sand may also include water. However, these materials may not include a water envelope barrier between the raw bitumen material and the mineral particles. Rather, the oil wet oil sand can comprise bitumen in direct physical contact with the mineral component of the oil sand.

In one aspect of the invention, a feed stream of oil sand is supplied to a contact zone, with the oil sand being comprised of at least 2 wt % of an oil composition, based on total weight of the supplied oil sand. Preferably, the oil sand feed is comprised of at least 4 wt % of an oil composition, more preferably at least 6 wt % of an oil composition, still more preferably at least 8 wt % of an oil composition, based on total weight of the oil sand feed. The oil composition on the oil sand feed refers to total hydrocarbon content of the oil sand feed, which can be determined according to the standard Dean Stark method.

Oil sand can have a tendency to clump due to some stickiness characteristics of the oil component of the oil sand. The oil sand that is fed to the contact zone should not be stuck together such that fluidization of the oil sand in the contact zone or extraction of the oil component in the contact zone is significantly impeded. In one embodiment, the oil sand that is provided or fed to the contact zone has an average particle size of not greater than 20,000 microns. Alternatively, the oil sand that is provided or fed to the contact zone has an average particle size of not greater than 10,000 microns, or not greater than 5,000 microns, or not greater than 2,500 microns.

As a practical matter, the particle size of the oil sand feed material should not be extremely small. For example, it is preferred to have an average particle size of at least 100 microns.

Extraction of High Quality Crude

High quality bitumen-derived crude oil can be extracted from oil sand using a propane-based type solvent as an initial or first solvent in an initial or first solvent extraction. The first solvent can be comprised of a hydrocarbon mixture, and the mixture can be comprised of at least two, or at least three or at least four different hydrocarbons.

The term "hydrocarbon" refers to any chemical compound that is comprised of at least one hydrogen and at least one carbon atom covalently bonded to one another (C—H). Preferably, the first solvent is comprised of at least 40 wt % hydrocarbon. Alternatively, the first solvent is comprised of at least 60 wt % hydrocarbon, or at least 80 wt % hydrocarbon, or at least 90 wt % hydrocarbon.

The first solvent can further comprise hydrogen or inert components. The inert components are considered compounds that are substantially unreactive with the hydrocarbon component or the oil components of the oil sand at the conditions at which the solvent is used in any of the steps of the process of the invention. Examples of such inert components include, but are not limited to, nitrogen, carbon dioxide and water, including water in the form of steam. Hydrogen, however, may or may not be reactive with the hydrocarbon or oil components of the oil sand, depending upon the conditions at which the solvent is used in any of the steps of the process of the invention.

Treatment of the oil sand with the first solvent is carried out as a vapor state treatment. For example, at least a portion of the first solvent in the vessel, which serves as a contact zone for the solvent and oil sand, is in the vapor state. In one embodiment, at least 20 wt % of the first solvent in the contact zone is in the vapor state. Alternatively, at least 40 wt %, or at least 60 wt %, or at least 80 wt % of the first solvent in the contact zone is in the vapor state.

The hydrocarbon of the first solvent can be comprised of a mix of hydrocarbon compounds. The hydrocarbon compounds can range from 1 to 20 carbon atoms. In an alternative embodiment, the hydrocarbon of the solvent is comprised of a mixture of hydrocarbon compounds having from 1 to 15, alternatively from 1 to 10, carbon atoms. Examples of such hydrocarbons include aliphatic hydrocarbons, olefinic hydrocarbons and aromatic hydrocarbons. Particular aliphatic hydrocarbons include paraffins as well as halogen-substituted paraffins. Examples of particular paraffins include, but are not limited to, propane, butane, pentane, hexane and heptane. Examples of halogen-substituted paraffins include, but are not limited to chlorine and fluorine substituted paraffins, such as $C_1$-$C_6$ chlorine or fluorine substituted or $C_1$-$C_3$ chlorine or fluorine substituted paraffins.

The use of high concentrations of propane has the advantage of extracting a crude oil low in asphaltene content. The first solvent, therefore, is comprised of a majority (i.e., at least 50 wt %, based on total weight of the first solvent) of propane. Higher concentrations are particularly desirable. For example, at least 80 wt %, or at least 90 wt %, or at least 95 wt %, %, or at least 98 wt % of the first solvent, based on total weight of the first solvent, can be propane. The asphaltene content of the extracted bitumen or bitumen-derived oil using the first solvent can be determined according to ASTM D4055-04 (2013) Standard Test Method for Pentane Insolubles by Membrane Filtration.

The first solvent can be a blend of relatively low boiling point compounds. For example, the first solvent can be a blend or mixture of propane and other low boiling point compounds. In a case in which the first solvent is a blend of compounds, the boiling range of first solvent compounds can be determined by batch distillation according to ASTM D86-09e1, Standard Test Method for Distillation of Petroleum Products at Atmospheric Pressure.

As an example, the first solvent can be a blend of propane and other low boiling point compounds, and the first solvent can have an ASTM D86 10% distillation point of greater than or equal to −50° C., but less than −10° C. Alternatively, the first solvent can have an ASTM D86 10% distillation point of greater than or equal to −45° C., but less than −10° C. For example, the first solvent can have an ASTM D86 10% distillation point within the range of from −50° C. to −10° C., alternatively within the range of from −45° C. to −20° C.

The first solvent can also be a blend of propane and other low boiling point compounds, in which the first solvent can have an ASTM D86 90% distillation point of not greater than 50° C. Alternatively, the first solvent can have an ASTM D86 90% distillation point of not greater than 30° C., or not greater than 10° C.

The first solvent can be represented by a blend of low boiling point compounds including propane, in which the first solvent can have some difference between its ASTM D86 90% distillation point and its ASTM D86 10% distillation point. For example, the first solvent can have a difference of at least 5° C. between its ASTM D86 90% distillation point and its ASTM D86 10% distillation point, alternatively a difference of at least 10° C., or at least 15° C. However, the difference between the first solvent's ASTM D86 90% distillation point and ASTM D86 10% distillation point should not be so great such that efficient recovery of solvent from extracted crude is impeded. For example, the first solvent can have a difference of not greater than 80° C. between its ASTM D86 90% distillation point and its ASTM D86 10% distillation point, alternatively a difference of not greater than 60° C., or not greater than 40° C., or not greater than 20° C.

Solvents high in aromatic content are not particularly desirable as first solvents. For example, the first solvent can have an aromatic content of not greater than 5 wt %, alternatively not greater than 2 wt %, or not greater than 1 wt %, or not greater than 0.5 wt %, based on total weight of the solvent injected into the extraction vessel. The aromatic content can be determined according to test method ASTM D6591-06 Standard Test Method for Determination of Aromatic Hydrocarbon Types in Middle Distillates-High Performance Liquid Chromatography Method with Refractive Index Detection.

Solvents high in ketone content are also not particularly desirable as first solvents. For example, the first solvent can have a ketone content of not greater than 3 wt %, alternatively not greater than 1 wt %, or not greater than 0.5 wt %, based on total weight of the solvent injected into the extraction vessel. The ketone content can be determined according to test method ASTM D4423-10 Standard Test Method for Determination of Carbonyls in $C_4$ Hydrocarbons.

In one embodiment, the first solvent can be comprised of hydrocarbon in which at least 80 wt % of the hydrocarbon is aliphatic hydrocarbon, based on total weight of the solvent. Alternatively, the solvent can be comprised of hydrocarbon in which at least 90 wt %, or at least 95 wt %, or at least 98 wt % of the hydrocarbon is aliphatic hydrocarbon, based on total weight of the solvent. Light aliphatic hydrocarbons are preferred, such as $C_3$-$C_5$ aliphatic hydrocarbons. Particular examples include at least a majority of propane, along with butane and/or pentane. Preferred is a mixture of propane and butane.

The first solvent preferably does not include substantial amounts of non-hydrocarbon compounds. Non-hydrocarbon compounds are considered chemical compounds that do not contain any C—H bonds. Examples of non-hydrocarbon compounds include, but are not limited to, hydrogen, nitrogen, water and the noble gases, such as helium, neon and argon. For example, the first solvent preferably includes not greater than 10 wt %, alternatively not greater than 3 wt %, alternatively not greater than 0.5 wt %, non-hydrocarbon compounds, based on total weight of the solvent injected into the extraction vessel.

Solvent to oil sand feed ratios can vary according to a variety of variables. Such variables include amount of hydrocarbon mix in the first solvent, temperature and pressure of the contact zone, and contact time of hydrocarbon mix and oil sand in the contact zone. Preferably, the first solvent and oil sand is supplied to the contact zone of the extraction vessel at a weight ratio of total hydrocarbon in the solvent to oil sand feed of at least 0.01:1, or at least 0.1:1, or at least 0.5:1 or at least 1:1. Very large total hydrocarbon to oil sand ratios are not required. For example, the first solvent and oil sand can be supplied to the contact zone of the extraction vessel at a weight ratio of total hydrocarbon in the solvent to oil sand feed of not greater than 4:1, or 3:1, or 2:1.

Extraction of oil compounds from the oil sand in the first extraction of crude oil from the bitumen is carried out in a contact zone such as in a vessel having a zone in which the first solvent contacts the oil sand. Any type of extraction vessel can be used that is capable of providing contact between the oil sand and the solvent such that a portion of the oil is removed from the oil sand. For example, horizontal or vertical type extractors can be used. The solid can be moved through the extractor by pumping, such as by auger-type movement, or by fluidized type of flow, such as free fall or free flow arrangements. An example of an auger-type system is described in U.S. Pat. No. 7,384,557. An example of fluidized type flow is described in US Patent Pub. No. 2013/0233772.

The first solvent can be injected into the vessel by way of nozzle-type devices. Nozzle manufacturers are capable of supplying any number of nozzle types based on the type of spray pattern desired.

The contacting of oil sand with first solvent in the contact zone of the extraction vessel is at a pressure and temperature in which at least 20 wt % of the hydrocarbon mixture within the contacting zone of the vessel is in vapor phase during contacting. Preferably, at least 40 wt %, or at least 60 wt % or at least 80 wt % of the hydrocarbon mixture within the contacting zone of the vessel is in vapor phase.

Carrying out the extraction process at the desired conditions using the desired first solvent enables controlling the amount of oil that is extracted from the oil sand. For example, contacting the oil sand with the first solvent in a vessel's contact zone can produce a crude oil composition comprised of not greater than 80 wt %, or not greater than 70 wt %, or not greater than 60 wt %, or not greater than 50 wt % of the bitumen from the supplied oil sand. That is, the first solvent is comprised of a hydrocarbon mix or blend that has the desired characteristics such that the first solvent extraction process can remove or extract not greater than 80 wt %, or greater than 70 wt %, or greater than 60 wt %, or not greater than 50 wt % of the bitumen from the supplied oil sand. This crude oil composition that leaves the extraction zone will also include at least a portion of the first solvent. However, a substantial portion of the first solvent can be separated from the crude oil composition to produce a crude oil product that can be pipelined, transported by other means such as railcar or truck, or further upgraded to make fuel products. The separated first solvent can then be recycled. Since the first extraction process incorporates a relatively light solvent blend relative to the crude oil composition, the first solvent portion can be easily recovered, with little if any external make-up being required.

The bitumen-derived crude oil composition will be reduced in metals and asphaltenes compared to typical processes. Metals content can be determined according to ASTM D5708-11 Standard Test Methods for Determination of Nickel, Vanadium, and Iron in Crude Oils and Residual Fuels by Inductively Coupled Plasma (ICP) Atomic Emission Spectrometry. For example, the crude oil composition can have a nickel plus vanadium content of not greater than 50 wppm, or not greater than 25 wppm, or not greater than 10 wppm, based on total weight of the composition.

As another example, the bitumen-derived crude oil composition can have an asphaltenes content (i.e., pentane insolubles measured according to ASTM D4055-04) of not greater than 5 wt %, or not greater than 3 wt %, or not greater than 1 wt %, or not greater than 0.05 wt %.

The bitumen-derived crude oil composition can also have a reduced Conradson Carbon Residue (CCR), measured according to ASTM D4530. For example, the crude oil composition can have a CCR of not greater than 10 wt %, or not greater than 5 wt %, or not greater than 3 wt %.

The first extraction is carried out at temperatures and pressures that allow at least a portion of the solvent to be maintained in the vapor phase in the contact zone, in which it is understood that vapor phase conditions in the contact zone are conditions in which the first solvent is below supercritical conditions. In cases in which the first solvent is a mixture of hydrocarbons, operating conditions are such that at least 80 wt %, or at least 90 wt %, or at least 100 wt % of the total first solvent injected into the contact zone is maintained at below supercritical conditions in the contact zone.

Since at least a portion of the first solvent is in the vapor phase in the contact zone, contact zone temperatures and pressures can be adjusted to provide the desired vapor and liquid phase equilibrium. Temperatures higher than the IUPAC established standard temperature of 0° C. are most practical. For example, the contacting of the oil sand and the solvent in the contact zone of the extraction vessel can be carried out at a temperature of at least 20° C., or at least 35° C., or at least 50° C., or at least 70° C. Upper temperature limits depend primarily upon physical constraints, such as contact vessel materials. In addition, temperatures should be limited to below cracking conditions for the extracted crude. Generally, it is desirable to maintain temperature in the contact vessel at not greater than 400° C., alternatively not greater than 300° C., or not greater than 100° C., or not greater than 80° C.

Pressure in the contact zone can vary as long as the desired amount of hydrocarbon in the solvent remains in the vapor phase in the contact zone. Pressures higher than the IUPAC established standard temperature of 1 bar is most practical. For example, pressure in the contacting zone can be at least 15 psia (103 kPa), or at least 50 psia (345 kPa), or at least 100 psia (689 kPa), or at least 150 psia (1034 kPa). Extremely high pressures are not preferred to ensure that at least a portion of the solvent remains in the vapor phase. For example, the contacting of the oil sand and the solvent in the contact zone of the extraction vessel can be carried out a pressure of not greater than 600 psia (4137 kPa), alternatively not greater than 500 psia (3447 kPa), or not greater than 400 psia (2758 kPa) or not greater than 300 psia (2068 kPa).

The crude oil composition that is removed from the contact zone of the extraction vessel in the first extraction further comprises at least a portion of the first solvent. At least a portion of the first solvent in the oil composition can be separated and recycled for reuse as solvent in the first extraction step. This separated solvent is separated so as to match or correspond within 50%, preferably within 30% or 20% or 10%, of the composition of any make-up first solvent, i.e., the overall chemical components and boiling points as described above for the solvent composition comprised of propane. For example, an extracted crude product containing the extracted crude oil and first solvent is sent to a separator and a light fraction is separated from a crude oil fraction in which the separated solvent has each of the compositional characteristics and each of the boiling point ranges within 50% of the above noted amounts, alternatively within 30% or 20% or 10% of the above noted amounts. This separation can be achieved using any appropriate chemical separation process. For example, separation can be achieved using any variety of evaporators, flash drums or distillation equipment or columns. The separated solvent can be recycled to contact oil sand, and optionally mixed with make-up first solvent having the characteristics indicated above.

Following removal of the bitumen-derived crude oil composition from the extraction vessel, the crude oil composition is separated into fractions comprised of recycle solvent and bitumen-derived crude oil product. The bitumen-derived crude oil product can be relatively high in quality in that it can have relatively low metals and asphaltenes content as described above. The low metals and asphaltenes content enables the crude oil product to be relatively easily upgraded to liquid fuels compared to typical bitumen oils.

The crude oil product will have a relatively high API gravity compared to the bitumen product extracted in a second solvent extraction. API gravity can be determined according to ASTM D287-92(2006) Standard Test Method for API Gravity of Crude Petroleum and Petroleum Products (Hydrometer Method). The crude oil product can, for example, have an API gravity of at least 8, or at least 10, or at least 12, or at least 14, depending on the exact solvent composition and process conditions.

Extraction of Asphaltene-Containing Bitumen

The oil sand that is provided as feedstock for treatment using a second solvent can be oil sand that has been mined and not previously solvent-treated (e.g., no first extraction using a first solvent) or oil sand that has been initially treated to remove a significant portion of low-asphaltene crude oil from the total bitumen on the originally mined oil sand. For example, oil sand feedstock provided for the second solvent extraction can be oil sand taken from a mining operation or oil sand product or tailings obtained from the first solvent treatment process steps of this invention. Therefore, the second solvent treatment can be carried out independent of or in conjunction with (e.g., in series with) the first solvent treatment process.

Oil sand feedstock that has been treated to remove at least a portion of the bitumen from mined oil sand can contain from 10% to 60% of the total weight of the bitumen present on the untreated oil sand. For example, the treated oil sand can contain from 15% to 55%, or 20% to 50%, or 25% to 45% of the total weight of the bitumen present on the untreated oil sand.

The oil sand that is provided as feedstock for treatment according to the second solvent extraction steps of this invention can also be oil sand that is low in overall bitumen content relative to the total weight of the oil sand. For example, the oil sand feedstock that is provided for a second solvent treatment can be comprised of not greater than 8 wt % total bitumen content, based on total weight of the oil sand feedstock. Alternatively, the oil sand feedstock that is provided for a second solvent treatment can be comprised of not greater than 6 wt % total bitumen content, or not greater than 4 wt % total bitumen content, based on total weight of the oil sand feedstock. The total bitumen content can be measured according to the Dean-Stark method (ASTM D95-05e1 Standard Test Method for Water in Petroleum Products and Bituminous Materials by Distillation).

In the second solvent extraction (i.e., bitumen extraction using the second solvent), the oil sand provided as feed stock is contacted with a solvent that is different from the solvent used in the first solvent extraction, since the solvent used in the second solvent extraction process will be a solvent that more readily solubilizes asphaltenic compounds present on the provided oil sand relative to the solvent used in the first extraction. The second solvent can be comprised of a hydrocarbon mixture, and the mixture can be comprised of at least two, or at least three or at least four different hydrocarbons.

The second solvent can further comprise hydrogen or inert components. The inert components are considered compounds that are substantially unreactive with the hydrocarbon component or the oil components of the oil sand at the conditions at which the solvent is used in any of the steps of the process of the invention. Examples of such inert components include, but are not limited to, nitrogen and water, including water in the form of steam. Hydrogen, however, may or may not be reactive with the hydrocarbon or oil components of the oil sand, depending upon the conditions at which the solvent is used in any of the steps of the process of the invention.

Treatment of the oil sand with the second solvent can be carried out under conditions in which at least a portion of the second solvent contacts the oil sand in a contact zone of a contactor in the liquid phase. For example, at least 70 wt % of the second solvent in the contact zone can be in the liquid phase. Alternatively, at least 75 wt %, or at least 80 wt %, or at least 90 wt % of the second solvent in the contact zone can be in the liquid phase.

The hydrocarbon of the second solvent can be comprised of a mix of low-boiling and high-boiling hydrocarbon compounds. For example, the low-boiling hydrocarbon compounds can range from 1 to 10 carbon atoms. The high-boiling compounds can be compounds greater than 10 carbon atoms.

The hydrocarbon of the second solvent can comprised of mixtures of aliphatic hydrocarbons, olefinic hydrocarbons and aromatic hydrocarbons. Particular aliphatic hydrocarbons include paraffins as well as halogen-substituted paraffins. Examples of particular paraffins include, but are not limited to propane, butane and pentane. Examples of halogen-substituted paraffins include, but are not limited to chlorine and fluorine substituted paraffins, such as $C_1$-$C_6$ chlorine or fluorine substituted or $C_1$-$C_3$ chlorine or fluorine substituted paraffins.

The second solvent is greater in solubility with asphaltenes than the first solvent used to obtain the high quality crude oil. Particularly effective solvents used in the second solvent extraction of this invention are propane and butane, mixed with a portion of higher boiling point compounds that are more highly soluble with asphaltenes that the propane and butane.

The second solvent can be considered solvent that is capable of removing a substantially greater portion of the bitumen from the oil sand than the first solvent, which is used to selectively extract a crude oil relatively low in asphaltene content from the bitumen on the oil sand. The second solvent can be comprised of a portion of the first solvent and a bitumen-derived crude oil, such as bitumen-derived crude oil extracted using the first solvent.

A particular example of a second solvent that is capable of removing a substantially greater portion of the high-asphaltene concentration bitumen than a first solvent is a solvent comprised of an admixture of a light aliphatic such as propane, butane or a combination of propane and butane, and a bitumen-derived crude oil component. An example of a bitumen-derived oil component is a bitumen-derived crude oil (i.e., crude oil that has been extracted from the oil sand) having an asphaltene content of not greater than 5 wt %. Thus, the second solvent can be comprised of an admixture of a light aliphatic such as propane, butane or a combination of propane and butane, and a fraction of the bitumen-derived crude oil component as previously described.

The term "admixture" can mean that the aliphatic compound can be mixed with the bitumen-derived crude oil component prior to adding to the contactor or extraction vessel. Alternatively, the term "admixture" can be understood to mean that aliphatic compound and the bitumen-derived crude oil component can be separately added to the contactor or extraction vessel and mixed within the vessel.

$C_3$-$C_4$ aliphatic compounds, such as propane and/or butane, can be used in the second solvent extraction solvent to enhance separation and recycle efficiency, as well as to enhance drying of the tailings solid material. For example, the second solvent can be comprised of at least 5 wt %, or at least 10 wt %, or at least 20 wt %, or at least 30 wt %, of at least one of propane and butane, with the overall second solvent composition still meeting the desired Hansen solubility parameters.

The second hydrocarbon solvent can be comprised of from 95 wt % to 5 wt % of at least one of the aliphatic compounds and from 5 wt % to 95 wt % of the bitumen-derived crude oil. Alternatively, the second hydrocarbon solvent can be comprised of from 90 wt % to 20 wt %, or from 80 wt % to 30 wt %, or from 70 wt % to 40 wt % of at least one of the aliphatic compounds and from 10 wt % to 80 wt %, or from 20 wt % to 70 wt %, or from 30 wt % to 60 wt % of the bitumen-derived crude oil.

Treatment of the oil sand with the second solvent that contains $C_3$-$C_4$ aliphatics, such as at least one of propane and butane, can be carried out under conditions in which at least a portion of the second solvent contacts the oil sand in a contact zone of a contactor in the vapor phase. For example, at least 5 wt % of the second solvent in the contact zone can be in the vapor phase. Alternatively, at least 10 wt %, or at least 15 wt %, or at least 20 wt % of the second solvent in the contact zone can be in the vapor phase.

The second solvent extraction solvent can contain bitumen-derived crude oil, as well as low-asphaltene or deasphalted crude oil obtained from a refinery process such as distillation or solvent extraction of a mineral oil based crude. For example, the second solvent extraction solvent can be comprised of from 5 wt % to 80 wt %, or 5 wt % to 60 wt %, or 5 wt % to 40 wt %, or 10 wt % to 40 wt % of bitumen-derived and/or deasphalted crude oil.

The second solvent that contains low-asphaltene, bitumen-derived and/or deasphalted crude oil can be characterized by a low asphaltenes content. For example, the second solvent can have an asphaltenes content (i.e., pentane insolubles measured according to ASTM D4055-04) of not greater than 5 wt %, or not greater than 3 wt %, or not greater than 1 wt %, or not greater than 0.05 wt %. Lower asphaltenes content of a crude oil-containing solvent provides an additional benefit in that there can be less plugging of filters and drain lines in the extraction vessel.

The second solvent can be a blend of relatively low boiling point compounds and relatively high boiling point compounds to further enhance separation and recycle efficiency, as well as to enhance drying of the tailings solid material. Since the second solvent can be a blend of low and high boiling compounds, the boiling range of compounds in the second solvent can be determined by ASTM D7169-11—Standard Test Method for Boiling Point Distribution of Samples with Residues Such as Crude Oils and Atmospheric and Vacuum Residues by High Temperature Gas Chromatography.

In one embodiment, the second solvent has an ASTM D7169 IBP of not greater than 10° C. Alternatively, the second solvent has an ASTM D7169 IBP of not greater than 0° C., or not greater than −10° C., or not greater than −20° C.

The second solvent can have an ASTM D7169 90% distillation point that is significantly higher than the IBP. For example, second solvent can have an ASTM D7169 90% distillation point that is at least 300° C., or at least 400° C., or at least 500° C. higher than the IBP of the solvent. The second solvent can have an ASTM D7169 90% distillation point within the range of from 300° C. to 800° C., alternatively within the range of from 400° C. to 700° C., or from 500° C. to 700° C.

A high ketone content in the second solvent can be useful but is not necessary. For example, the second solvent can have a ketone content of at least 1 wt %, or at least 2 wt %, based on total weight of the solvent injected into the extraction vessel. However, total ketone content can be limited to not greater than 10 wt %, alternatively not greater than 5 wt %, or not greater than 3 wt %, based on total weight of the solvent injected into the extraction vessel. The ketone content can be determined according to test method ASTM D4423-10 Standard Test Method for Determination of Carbonyls in $C_4$ Hydrocarbons.

A high halohydrocarbon content in the second solvent can also be useful but is not necessary. For example, the second solvent can have a halohydrocarbon content of at least 1 wt %, or at least 2 wt %, based on total weight of the solvent injected into the extraction vessel. However, total halohydrocarbon content can be limited to not greater than 10 wt %, alternatively not greater than 5 wt %, or not greater than 3 wt %, based on total weight of the solvent injected into the extraction vessel. The halohydrocarbon content can be determined according to test method ASTM E256-09—Standard Test Method for Chlorine in Organic Compounds by Sodium Peroxide Bomb Ignition.

A high ester content in the second solvent can additionally be useful but is not necessary. For example, the second solvent can have an ester content of at least 1 wt %, or at least 2 wt %, based on total weight of the solvent injected into the extraction vessel. However, total ester content can be limited to not greater than 10 wt %, alternatively not greater than 5 wt %, or not greater than 3 wt %, based on total weight of the solvent injected into the extraction vessel. The ester content can be determined according to test method ASTM D1617-07(2012)—Standard Test Method for Ester Value of Solvents and Thinners.

The second solvent preferably does not include substantial amounts of non-hydrocarbon compounds. Non-hydrocarbon compounds are considered chemical compounds that do not contain any C—H bonds. Examples of non-hydrocarbon compounds include, but are not limited to, hydrogen, nitrogen, water and the noble gases, such as helium, neon and argon. For example, the solvent preferably includes not greater than 20 wt %, alternatively not greater than 10 wt %, alternatively not greater than 5 wt %, non-hydrocarbon compounds, based on total weight of the solvent injected into the extraction vessel.

Solvent to oil sand feed ratios using a second solvent type of extraction can vary according to a variety of variables. Such variables include amount of hydrocarbon mix in the solvent, temperature and pressure of the contact zone, and contact time of hydrocarbon mix and oil sand in the contact zone. Preferably, the solvent and oil sand is supplied to the contact zone of the extraction vessel at a weight ratio of total hydrocarbon in the solvent to oil sand feed of at least 0.01:1, or at least 0.1:1, or at least 0.5:1 or at least 1:1. Very large total hydrocarbon to oil sand ratios are not required. For example, the solvent and oil sand can be supplied to the contact zone of the extraction vessel at a weight ratio of total hydrocarbon in the solvent to oil sand feed of not greater than 4:1, or 3:1, or 2:1.

The bitumen product recovered from the second solvent extraction can be used as desired. For example, the bitumen product can be sent to a refinery for upgrading to a higher quality petroleum product such as a synthetic crude or for further grading into a transportation fuel such as a component of diesel, jet fuel or gasoline. Alternatively, at least a portion of the bitumen product can be used as an asphalt binder for concrete or roofing materials.

Extraction of bitumen product from oil sand in the second solvent extraction can be carried out in a contact zone of a vessel. For example, a second solvent type of extraction can be carried out in a vessel of a type similar to that described according to the first extraction of crude oil from oil sand. The contacting of the oil sand with the second solvent is at a temperature and pressure to provide the desired solvent vapor and liquid phases within the vessel. Each of the compositional characteristics of the second solvent described above is based on the total amount of second solvent injected into a contactor vessel. This would include recycle lines in cases in which recycle lines exist.

Drying of Tailings

The oil sand that has been treated with the second solvent (i.e., tailings) will have a very low bitumen content. For example, the tailings have a total bitumen content of not greater than 0.5 wt %, based on total weight of the treated sand. Alternatively, tailings can have a total bitumen content of not greater than 0.3 wt %, not greater than 0.1 wt %, based on total weight of the treated sand.

The tailings can also comprise some amount of treatment solvent or other lighter hydrocarbon material relative to the bitumen remaining on the sand. To remove the lighter materials and/or water from the tailings, the tailings can be treated or dried with a drying composition. The drying composition is preferably comprised of a majority (i.e., at least 50 wt %, based on total weight of the drying composition) of propane. Higher concentrations are particularly desirable. For example, at least 80 wt %, or at least 90 wt %, or at least 95 wt %, %, or at least 98 wt % of the drying composition, based on total weight of the drying composition, can be propane.

Drying is carried out at temperatures effective to remove a substantial amount of the treatment solvent or other lighter hydrocarbon material remaining on the tailings. For example, drying is carried out at temperatures higher than that of the boiling point of the drying composition. As a particular example, drying can be carried out by contacting the tailings at a temperature of at least 25° C., or at least 50° C., or at least 75° C. higher than that of propane. As another example, drying can be carried out by contacting the tailings at a temperature of from 25° C. to 200° C., or from 30° C. to 150° C., or from 50° C. to 125° C.

The drying composition is contacted with the tailings at a flow rate high enough to transfer enough heat to the tailings to effectively remove a substantial amount of the treatment solvent or other lighter hydrocarbon material remaining on the tailings. For example, the drying composition can provided to the contact zone of a treatment compartment or vessel at a superficial velocity sufficient to fluidize the tailings within the contact zone. Superficial velocity is considered the volumetric flow rate of the fluidizing medium moving through the contact zone divided by the cross-sectional area of the contact zone. Since cross-sectional area may vary in the contact zone, the superficial velocity can vary within the contact zone. However, the superficial velocity at any given point within the contact zone will be sufficient to ensure fluidization.

The superficial velocity can also vary depending upon particle size of the tailings. The larger the particle size, the greater the superficial velocity. Preferably, the superficial velocity in the contact zone is greater than or equal to 0.1 meter per second (m/s). As particle size of the tailings may be larger, the superficial velocity in the contact zone may be greater than or equal to 0.2 m/s, or greater than or equal to 0.5 m/s, or greater than or equal to 1 m/s, or greater than or equal to 5 m/s.

In certain cases, it may be desirable to form a fluidized bed having a relatively defined upper bed limit or tailings particles, i.e., fluidized beds other than a dilute-phase fluidized bed. In such cases, superficial velocity can be reduced. For example, in such cases, superficial velocity may be not greater than 10 m/s or not greater than 5 m/s.

EXAMPLES

Example 1

Extraction of High Quality Crude Oil

Oil sands ore from leases located just north of Fort McMurray, Alberta in the Athabasca region is obtained. In carrying out a Dean Stark test on the ore, it is determined that the total bitumen content of the ore is approximately 6 wt %, based on total weight of the ore.

The ore is crushed and fed to an extraction chamber. The crushed ore is moved through the extraction chamber, while being contacted with propane solvent, representing a first solvent. The extraction chamber consists of an auger type moving device in which the auger is used to move the particles through the chamber, and the first solvent is injected into the extraction chamber as the particles move through the extraction chamber. An example of the device is depicted in U.S. Pat. No. 7,384,557.

The extraction is carried out at approximately a temperature of 80° F. (27° C.) and a pressure of 148 psia (10.1 atm). Approximately 60 wt % of the bitumen is determined to be extracted from the oil sand, with the remainder of the bitumen staying attached to the oil sand.

Following extraction of the oil from the ore, a mixture of the crude oil and solvent is collected. The solvent is separated from the crude oil by flash evaporation.

The separated crude oil is analyzed. Analytical results are provided in the following Table 1.

TABLE 1

| CRUDE OIL TEST | CRUDE TEST RESULT |
|---|---|
| API | 15.9 |
| Distillation, ° F. (ASTM D7169) | |
| IBP | 361 |
| 5% | 469 |
| 10% | 525 |
| 50% | 821 |
| 90% | 1186 |
| 95% | 1267 |
| EP | 1360 |
| Total Sulfur, wt % (ASTM D 4294) | 3.57 |
| Total Nitrogen, wt % | 0.2 |
| Total Hydrogen, wt % | 11.6 |
| Total Carbon, wt % | 84 |
| CCR, wt % (ASTM D4530) | 2.6 |
| Metals | |
| Nickel, ppm | 4.9 |
| Vanadium, ppm | 7.53 |
| Pour Point, ° C. (ASTM D97) | −24 |

Example 2

Preparation of Solvent for Extraction of Asphaltene-Containing Bitumen

Solvents for extracting the remainder of the bitumen on the extracted oil sand in Example 1 are prepared by mixing together varying amounts of propane and the bitumen-derived crude oil described in Example 1. The prepared solvents are as shown in Table 2

TABLE 2

| Solvent Composition (Crude/Propane, wt %) |
|---|
| 80/20 |
| 50/50 |
| 20/80 |

Example 3

Extraction of High Asphaltene-Content Bitumen

The treated oil sand from the extraction process of Example 1 is subjected to additional extraction using the solvents prepared according to Example 2 and according to process conditions as described in Example 1. It is expected that the solvents shown in Table 2 will be increasingly effective in removing the remainder of the bitumen from the oil sand treated in Example 1 as follows: 80/20>50/50>20/80. The bitumen removed using the solvents will be higher in asphaltene content that the crude oil recovered in Example 1.

Example 4

Drying of Tailings

100. Following extraction of the high-asphaltene-content bitumen from the oil sands in Example 3, the remaining oil sand (i.e., tailings) is placed into a weighed empty pressure vessel. The vessel and sample are weighed, and the weight of the tailings is recorded. The vessel is attached to a solenoid to provide some mixing, and propane nitrogen is added to the vessel. The vessel is maintained at a temperature of about 150° F. (66° C.) and a pressure of about 100 psi (689 kPa). After mixing is carried out for one hour, the vessel is removed from the solenoid and cooled to room temperature. The gas phase of the vessel is transferred to a pre-weighed empty gas bag and the weight of the bag plus gas is taken. The difference is propane (plus other gases produced during the drying step) plus the weight of nitrogen added. The weight of nitrogen added is calculated based on the volume of the vessel, and the temperature and pressure at which the nitrogen was added prior to heating.

The gas removed from the vessel is subjected to quantitative gas chromatograph (GC) analysis for propane and other gases, and the weight of propane is determined. The weight of the gas depleted tailings is determined by weighing the vessel and its contents and subtracting the weight of the tared vessel. The initial weight of the tailings is noted and compared with the sum of the weights of the evolved gas (propane) plus the weight of the "dried" tailings, determined on a material balance. It should be found that no more than 1 wt % of propane, or no more than 0.5 wt % of propane or no more than 0.1 wt % of propane remains on the "dried" tailings.

The principles and modes of operation of this invention have been described above with reference to various exemplary and preferred embodiments. As understood by those of skill in the art, this invention also encompasses a variety of preferred embodiments within the overall description of the invention as defined by the claims, which embodiments have not necessarily been specifically enumerated herein.

The invention claimed is:

1. A process for producing a bitumen-derived crude oil composition and a heavy bitumen composition from an oil sand feedstock, comprising:

treating the oil sand feedstock with a first hydrocarbon solvent to produce the bitumen-derived crude oil composition and an oil-depleted oil sand, wherein the oil sand feedstock is comprised of at least 6 wt % bitumen, based on total weight of the oil sand, and the first hydrocarbon solvent is comprised of a majority of propane;

separating the bitumen-derived crude oil composition from the oil-depleted oil sand, wherein the bitumen-derived crude oil composition has an asphaltene content of not greater than 5 wt % pentane insolubles measured according to ASTM D4055-04, and the oil-depleted oil sand contains less bitumen than that on the oil sand feedstock;

treating the oil-depleted oil sand with a second hydrocarbon solvent to produce the heavy bitumen composition and oil sand tailings, wherein the second hydrocarbon solvent is comprised of propane and a fraction of the bitumen-derived crude oil composition; and contacting the oil sand tailings with a drying composition comprised of a majority of propane.

2. The process of claim 1, wherein the first hydrocarbon solvent is comprised of at least 80 wt % propane.

3. The process of claim 2, wherein the first hydrocarbon solvent has a ketone content of less than 5 wt %.

4. The process of claim 2, wherein the first hydrocarbon solvent has an aromatic content of less than 5 wt %.

5. The process of claim 1, wherein the second hydrocarbon solvent is comprised of from 95 wt % to 5 wt % of the propane and from 5 wt % to 95 wt % of the bitumen-derived crude oil composition.

6. The process of claim 5, wherein the bitumen-derived crude oil composition has a nickel plus vanadium content of not greater than 50 wppm, based on total weight of the composition.

7. The process of claim 5, wherein the bitumen-derived crude oil composition has an asphaltene content of not greater than 3 wt % pentane insolubles.

8. The process of claim 5, wherein the bitumen-derived crude oil composition has a Conradson Carbon Residue (CCR), measured according to ASTM D4530, of not greater than 10 wt %.

9. The process of claim 1, wherein the drying composition is comprised of at least 80 wt % propane.

10. The process of claim 1, wherein the second hydrocarbon solvent has an ASTM D7169 IBP of not greater than 100° C.

11. The process of claim 10, wherein the second hydrocarbon solvent has an ASTM D7169 50% distillation point within the range of from 100° C. to 450° C.

* * * * *